US007131892B2

(12) United States Patent
Fuhriman et al.

(10) Patent No.: US 7,131,892 B2
(45) Date of Patent: Nov. 7, 2006

(54) WAFER CARRIER WITH PRESSURIZED MEMBRANE AND RETAINING RING ACTUATOR

(75) Inventors: John Fuhriman, San Luis Obispo, CA (US); Carlton Wells, San Luis Obispo, CA (US); Bill Kalenian, San Luis Obispo, CA (US); Larry Spiegel, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 11/410,440

(22) Filed: Apr. 24, 2006

(65) Prior Publication Data

US 2006/0194519 A1 Aug. 31, 2006

Related U.S. Application Data

(63) Continuation of application No. 11/055,550, filed on Feb. 10, 2005, now Pat. No. 7,033,252.

(60) Provisional application No. 60/550,806, filed on Mar. 5, 2004.

(51) Int. Cl.
*B24B 1/00* (2006.01)

(52) U.S. Cl. ..... 451/41; 451/288

(58) Field of Classification Search ..... 451/36, 451/41, 285, 286, 287, 288, 289
See application file for complete search history.

(56) References Cited

U.S. PATENT DOCUMENTS

| | | | | |
|---|---|---|---|---|
| 5,795,215 | A | 8/1998 | Guthrie et al. | 451/286 |
| 6,019,670 | A | 2/2000 | Cheng et al. | 451/56 |
| 6,024,630 | A | 2/2000 | Shendon et al. | 451/41 |
| 6,368,189 | B1 | 4/2002 | Maloney et al. | 451/41 |
| 6,506,105 | B1 | 1/2003 | Kajiwara et al. | 451/289 |
| 6,716,094 | B1 | 4/2004 | Shendon et al. | 451/288 |
| 6,746,318 | B1 | 6/2004 | Mallery et al. | 451/285 |
| 6,869,348 | B1 | 3/2005 | Spiegel | 451/398 |
| 6,890,249 | B1 | 5/2005 | Zuniga et al. | 451/398 |
| 6,976,908 | B1 * | 12/2005 | Masunaga et al. | 451/288 |
| 2003/0151153 | A1 * | 8/2003 | Jarvinen et al. | 264/33 |
| 2004/0102138 | A1 | 5/2004 | Saldana | 451/28 |
| 2004/0235399 | A1 | 11/2004 | Owczarz et al. | 451/41 |

* cited by examiner

*Primary Examiner*—Jacob K. Ackun, Jr.
(74) *Attorney, Agent, or Firm*—Crockett & Crockett; Marc J. Frechette, Esq.

(57) ABSTRACT

A wafer carrier for controlling downward force and edge effect during chemical mechanical planarization. A retaining ring actuator is disposed within the retaining ring to control the height of the retaining ring relative to the bottom surface of the wafer carrier. An inflatable membrane is disposed across the bottom surface of the wafer carrier such that pressure in the bladder is independently regulated to control the downward force acting on the wafer during CMP. In addition, an edge control bladder may also be disposed within the carrier such that if the pressure in the bladder is also regulated, the amount of force on the edge of the wafer changes. By regulating retaining ring actuator pressure, inflatable membrane pressure, and edge control bladder pressure, non-uniformities in the wafer surface and edge effect may be addressed during CMP.

15 Claims, 4 Drawing Sheets

21
10
1
20
5
5
4
22
2
3
3
2
8
8
9
9
7
6

WAFER CARRIER WITH PRESSURIZED MEMBRANE AND RETAINING RING ACTUATOR

This application is a continuation application of U.S. application Ser. No. 11/055,550, filed Feb. 10, 2005, now U.S. Pat. No. 7,033,252, which claims priority to U.S. provisional application 60/550,806, filed Mar. 5, 2004.

FIELD OF THE INVENTIONS

The inventions described below relate the field of wafer carriers and particularly to wafer carriers used during chemical mechanical planarization of silicon wafers.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical-mechanical planarization (CMP) is a process used during device manufacturing to flatten wafers and the layers built-up on wafers to the necessary degree of flatness.

Chemical-mechanical planarization is a process involving polishing of a wafer with a polishing pad combined with the chemical and physical action of a slurry pumped onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing. (CMP is therefore achieved by a combination of chemical softener and physical downward force that removes material from the wafer or wafer layer.) The downward force, referred to in this application as the Spindle Force, is split in the wafer carrier to a Retaining Ring Force and a Wafer Force.

Using the CMP process, a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated to build complete integrated circuit chips on the wafer surface.

A variety of wafer carrier configurations are used during CMP. One such wafer carrier configuration is the hard backed configuration. The hard backed configuration utilizes a rigid surface such as a piston or backing plate against the backside of the silicon wafer during CMP forcing the front surface of the silicon wafer to the surface of the polishing pad. Using this type of carrier may not conform the front wafer surface of the wafer to the surface of the polishing pad resulting in planarization non-uniformities. Such hard backed wafer carrier designs generally utilize a relatively high polishing pressure. These relatively high pressures effectively deform the wafer to match the surface conformation of the polishing pad. When wafer surface distortion occurs, the high spots are polished at the same time as the low spots giving some degree of uniformity but also resulting in poor planarization. Too much material from some areas of the wafer will be removed and too little material from other areas will also be removed. In addition to wafer distortion, the relatively high pressure also results in excessive material removal along the edges of the silicon wafer. When the amount of material removed is excessive, the entire wafer or portions of the wafer become unusable.

In other wafer carrier configurations, the wafer is pressed against the polishing pad using a membrane or other soft material. Use of a membrane carriers tend to not cause distortion of the wafer. Lower polishing pressures may be employed, and conformity of the wafer front surface is achieved without distortion so that both some measure of global polishing uniformity and good planarization may be achieved. Better planarization uniformity is achieved at least in part because the polishing rate on similar features from die to die on the wafer is the same.

While many soft backed wafer carrier configurations are used in CMP, their use has not been entirely satisfactory. In some carrier designs, there have been attempts to use a layer of pressurized air over the entire surface of the wafer to press the wafer during planarization. Unfortunately, while such approaches may provide a soft back for the wafer carrier, it does not permit independent adjustment of the pressure at the edge of the wafer and at more central regions of the wafer to solve the wafer edge non-uniformity problems.

In order to correct or compensate for edge polishing effects, attempts have been made to adjust the shape of the retaining ring and to modify a retaining ring pressure so that the amount of material removed from the wafer near the retaining ring was modified. Typically, more material is removed from the edge of the wafer resulting in over polishing. In order to correct this over polishing, usually, the retaining ring pressure is adjusted to be somewhat lower than the wafer backside pressure so that the polishing pad in that area was somewhat compressed by the retaining ring and less material was removed from the wafer within a few millimeters of the retaining ring. These attempts, however, have not been entirely satisfactory as the planarization pressure at the outer peripheral edge of the wafer was only indirectly adjustable based on the retaining ring pressure. It was not possible to extend the effective distance of a retaining ring compensation effect an arbitrary distance into the wafer edge. Neither was it possible to independently adjust the retaining ring pressure, edge pressure, or independently adjust backside wafer pressure with respect to retaining ring pressure to achieve a desired result.

There remains a need for a membrane backed wafer carrier having independent control of both the membrane pressure and retaining ring pressure providing excellent planarization, control of edge planarization effects, and adjustment of the wafer material removal profile to compensate for non-uniform deposition of the structural layers on the wafer semiconductor substrate.

SUMMARY

The methods and devices described below provide for a wafer carrier adapted to greatly reduce the edge effect and allow a wafer to be uniformly polished across its entire surface. A wafer carrier having a pressure-regulated soft membrane behind the wafer, a retaining ring having a retaining ring actuator, and a pressurized edge control bladder or resilient ring is used during CMP. Pressures behind the soft membrane, within the retaining ring actuator, and within the edge control bladder are regulated independently from one another. This enables the wafer carrier to account for non-uniformities on the wafer surface, changes in the retaining ring, and edge effect.

DETAILED DESCRIPTION OF THE INVENTIONS

Figure 1:
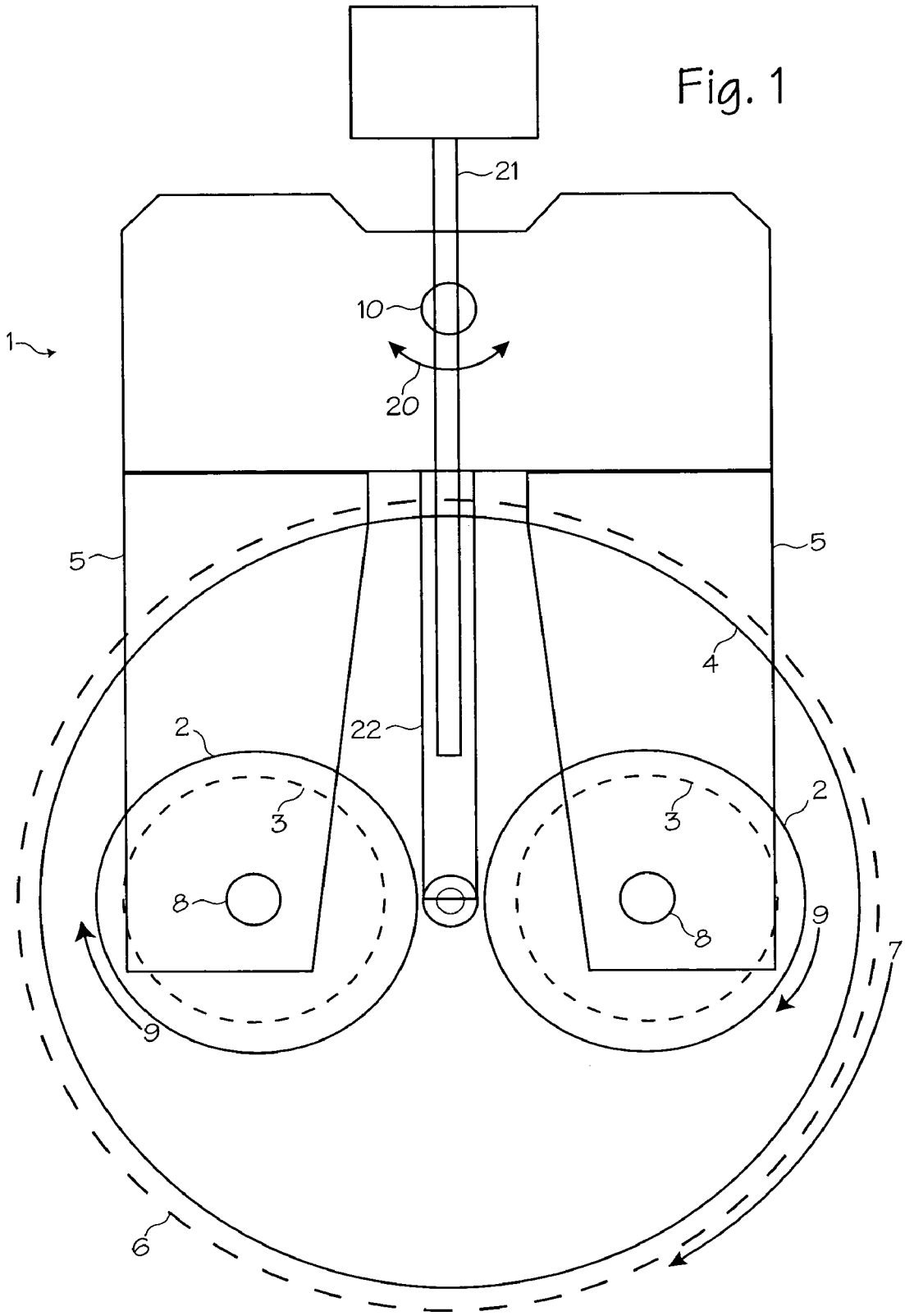
FIG. 1 shows a system for performing chemical mechanical planarization.

FIG. 1 shows a system 1 for performing chemical mechanical planarization (CMP). One or more polishing heads or wafer carriers 2 hold wafers 3 (shown in phantom to indicate their position underneath the wafer carrier) suspended over a polishing pad 4. A wafer carrier 2 thus has a means for securing and holding a wafer 3. The wafer carriers 2 are suspended from translation arms 5. The polishing pad is disposed on a platen 6, which spins in the direction of arrows 7. The wafer carriers 2 rotate about their respective spindles 8 in the direction of arrows 9. The wafer carriers 2 are also translated back and forth over the surface of the polishing pad by the translating spindle 10, which moves as indicated by arrows 20. The slurry used in the polishing process is injected onto the surface of the polishing pad through slurry injection tube 21, which is disposed on or through a suspension arm 22. (Other chemical mechanical planarization systems may use only one wafer carrier 2 that holds one wafer 3, or may use several wafer carriers 2 that hold several wafers 3. Other systems may also use separate translation arms to hold each carrier.)

Figure 2:
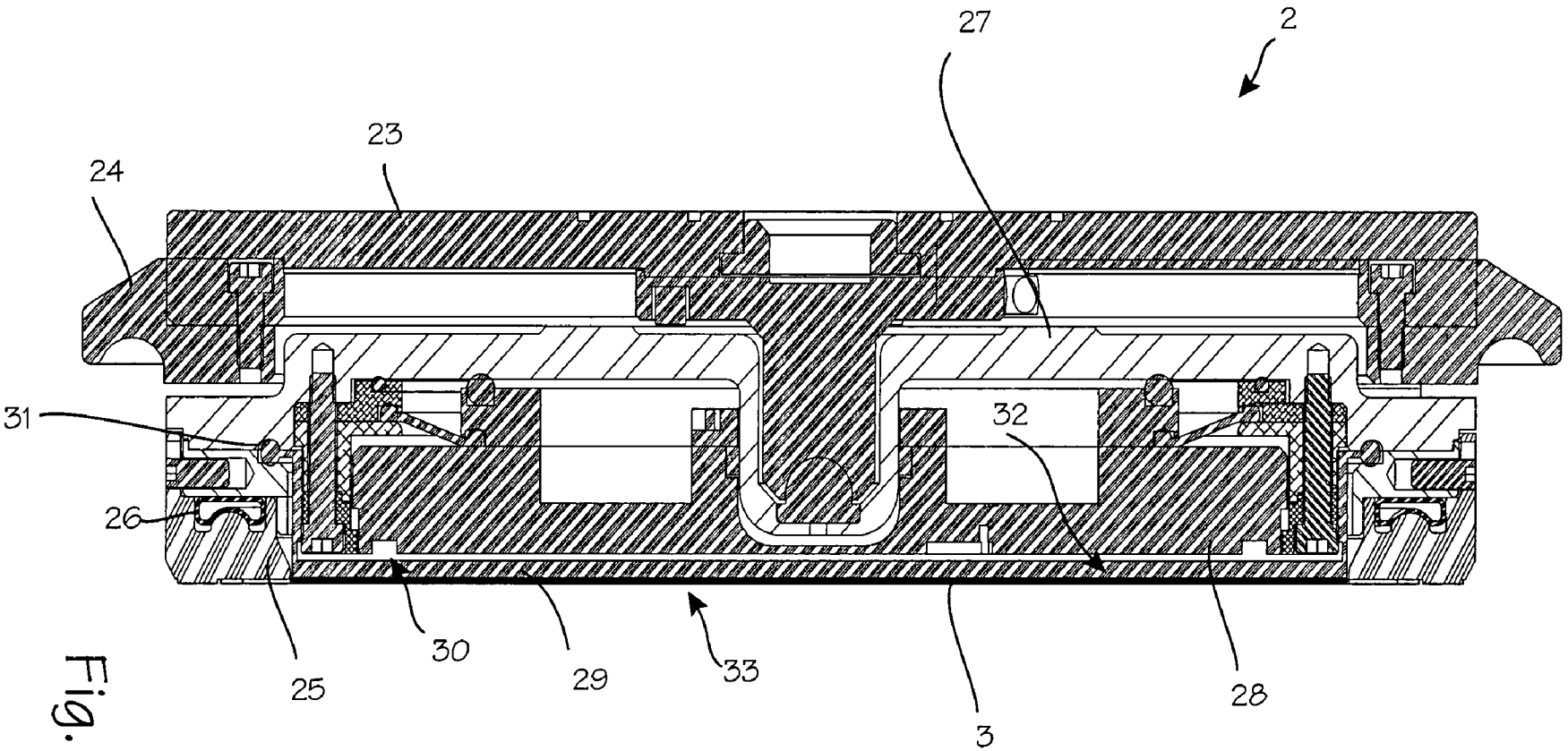
FIG. 2 shows a cross-sectional view of a wafer carrier having a pressure-regulated soft membrane and retaining ring actuator.

FIG. 2 shows a cross section of a wafer carrier. The wafer carrier 2 includes, a top plate 23 couplable to the spindle 8, a housing 24 coupled to the top plate 23, a gimbal plate 27 coupled to the housing, a retaining ring 25 coupled to the gimbal plate 27, a retaining ring actuator 26 disposed in the retaining ring 25, a piston plate 28 having one degree of freedom in the vertical direction coupled to the gimbal plate 27, and a pressure regulated soft membrane 29. The membrane may be made of a synthetic rubber or other pliable material. The piston plate 28 is disposed within the inner diameters of the housing 24 and retaining ring 25. When a pressurized fluid is applied, the pressurized fluid flows through the passage to the recessed regions in the lower face 30 of the piston plate 28. The fluid may be liquid or gaseous. The pressurized fluid urges the soft membrane 29 downwardly away from the lower face 30 of the piston plate 28. (At the same time, the pressurized fluid pushes the piston plate 28 upward.)

The soft membrane 29 extends horizontally over a peripheral portion of the backside of the wafer 3 and extends vertically between the side of the piston plate 28 and the retaining ring 25 and gimbal plate 27. An extension of the membrane 29 projects into an annular space 31 provided in the gimbal plate 27. Thus, the pressure-regulated soft membrane 29 moves with the wafer and the piston plate but, during polishing, moves independently of the movement of the gimbal plate 27 and the retaining ring 25. Pressure in the soft membrane is adjusted by a control computer to apply downward force to the backside 32 of the wafer and to ensure that the rate at which material is removed from the front side 33 of the wafer is uniform across the entire front side of the wafer.

The retaining ring actuator in the wafer carrier 2 is independently controlled and affects the amount of force being applied behind the retaining ring 25. A retaining ring actuator 26 is provided within the retaining ring 25. When the actuator is pressurized, it extends against the retaining ring and increases the amount of force being applied to the polishing pad by the retaining ring relative to the rest of the wafer carrier 2. The retaining ring 25 is attached to the gimbal plate 27 in such a manner that allows the pressure inside the retaining ring actuator 26 to be increased or decreased. Change of pressure within the retaining ring actuator will influence the amount of force acting on the polishing pad by the retaining ring. Using a control computer, pressure in the retaining ring actuator 26 is regulated independent of the pressure in the inflatable membrane 29 and pressure in the edge control bladder 37. Pressure inside the retaining ring actuator 26 is used to force the retaining ring 25 downwardly as material is removed from the bottom surface of the retaining ring 25.

Polishing removes material from the bottom surface of the retaining ring, particularly over the course of multiple polishing runs. When the carrier 2 is in use, the soft membrane pressure, retaining ring actuator pressure, and edge control bladder pressure can all be regulated independently. This enables an operator to account for non-uniformities on the wafer surface, changes in the height of the retaining ring, and edge effect while using a CMP tool. Thus, the front side 33 of the wafer will remain substantially co-planar with the bottom surface of the retaining ring even as material is removed from the bottom surface of the retaining ring. The retaining ring actuator 26 and the fluid inside it allow the retaining ring 25 to move independently of the wafer 3 and the inflatable membrane 29.

Figure 3:
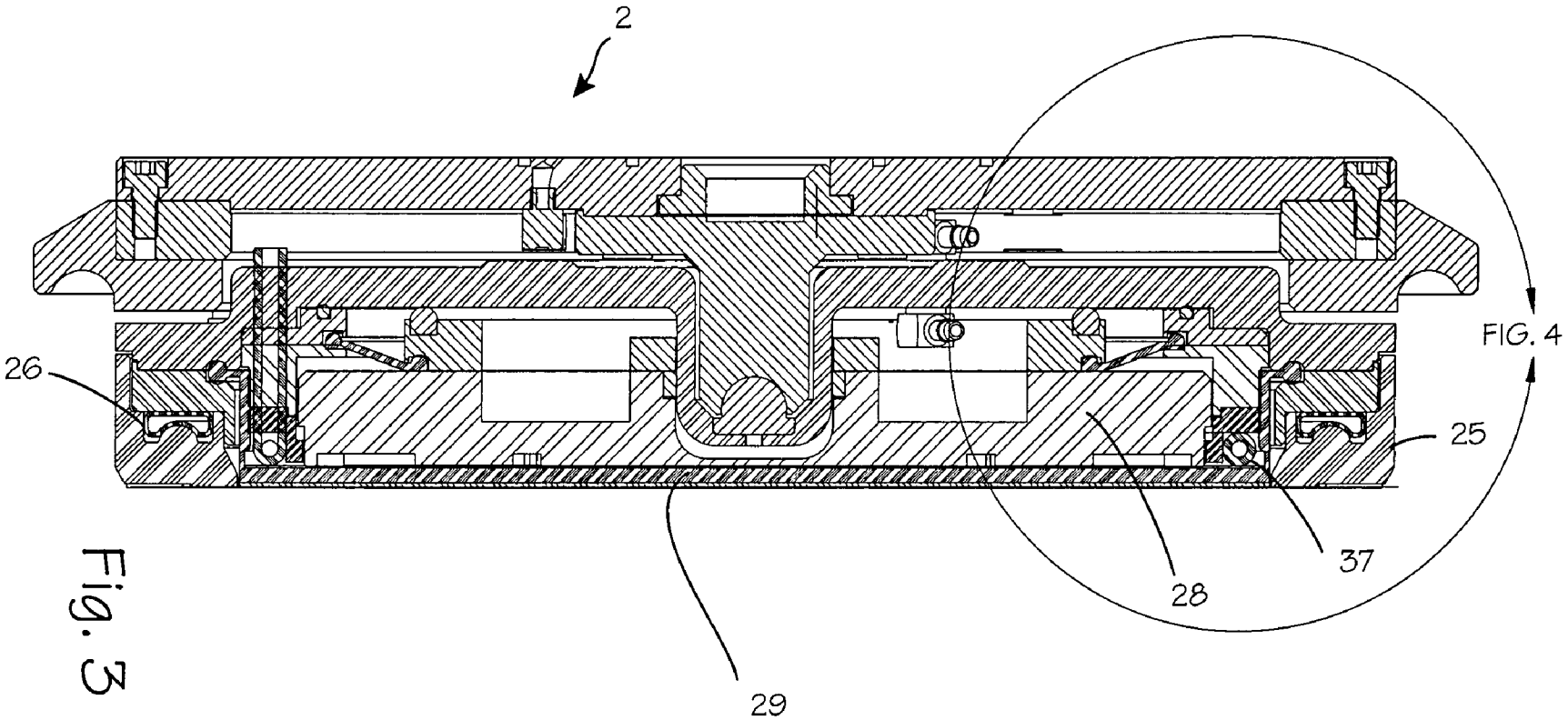
FIG. 3 shows a cross-sectional view of a wafer carrier having a pressure-regulated soft membrane, pressure regulated retaining ring actuator, and an edge control bladder.

FIG. 3 shows a cross-sectional view of a wafer carrier 2 having a pressure-regulated soft membrane, a retaining ring with a retaining ring actuator, and an edge control bladder. The wafer carrier with a soft membrane and retaining ring actuator 26 may be provided with a tubular hoop bladder between the piston plate 28 and retaining ring 26 behind the pressure-regulated soft membrane 29. (Because the hoop bladder is used to control the edge effect, the bladder is referred to as an edge control bladder 37.) In use, pressure inside the edge control bladder 37 is independently regulated from both the pressure in the retaining ring actuator 26 and the pressure in the inflatable membrane 29 by a control computer. The pressure in the edge control bladder 37 is regulated to either increase or decrease the amount of force the bladder 37 applies along the edge of the wafer 3. The edge of the wafer is considered to be the circumferential outer 5% of the surface area of the wafer. For center-slow processes, pressure in the edge control bladder 37 is regulated such that the amount of force applied to the wafer 3 in the area of edge control bladder 37 is less than the amount of force applied to the rest of the wafer 3. (Downward force on the wafer 3 is applied via the downward force applied by the soft membrane 29 and the pressure behind the soft membrane 29 is adjusted independently from the pressure within the edge control bladder 37.) Because less force is applied to the edge of the wafer 3 than the central portion of the wafer 3, the edge effect is lessened. Alternatively, more force can be applied to the edge of the wafer using the edge control bladder 37 when necessary.

The soft membrane 29 and the edge of the wafer 3 move up and down relative to the carrier 2, thereby allowing the force applied to the edge of the wafer 3 to vary relative to the force applied to the rest of the wafer 3. Thus, pressure in the edge control bladder 37 and pressure behind the soft membrane 29 may be regulated such that the rate at which polishing removes material from the wafer 3 is uniform across the entire front side 33 of the wafer 3.

The edge control bladder 37 and soft membrane 29 also reduce vibration of the carrier system including the wafer carrier 2 and the wafer 3. The fluids used in the edge control bladder 37 and behind the soft membrane 29 function as dampeners. Pressure in the edge control bladder 37 and behind the soft membrane 29 may be adjusted to reduce the amount of vibration in the carrier system.

In another embodiment of the wafer carrier, active regulation of the pressure in the edge control bladder 37 is not provided. As an alternative to active edge control, a passive annular bladder filled with a fluid pressurized to a predetermined pressure. Alternatively, a substantially solid ring of resilient material can also be used in the wafer carrier. The passive annular bladder or a ring of resilient material is located between the piston plate 28 and retaining ring behind the inflatable membrane 29. The pressure in the bladder or the resiliency of the material is selected to adjust the force applied to the edge of the wafer 3 in order to ensure a uniform rate of material removal from the front side of the wafer.

Figure 4:
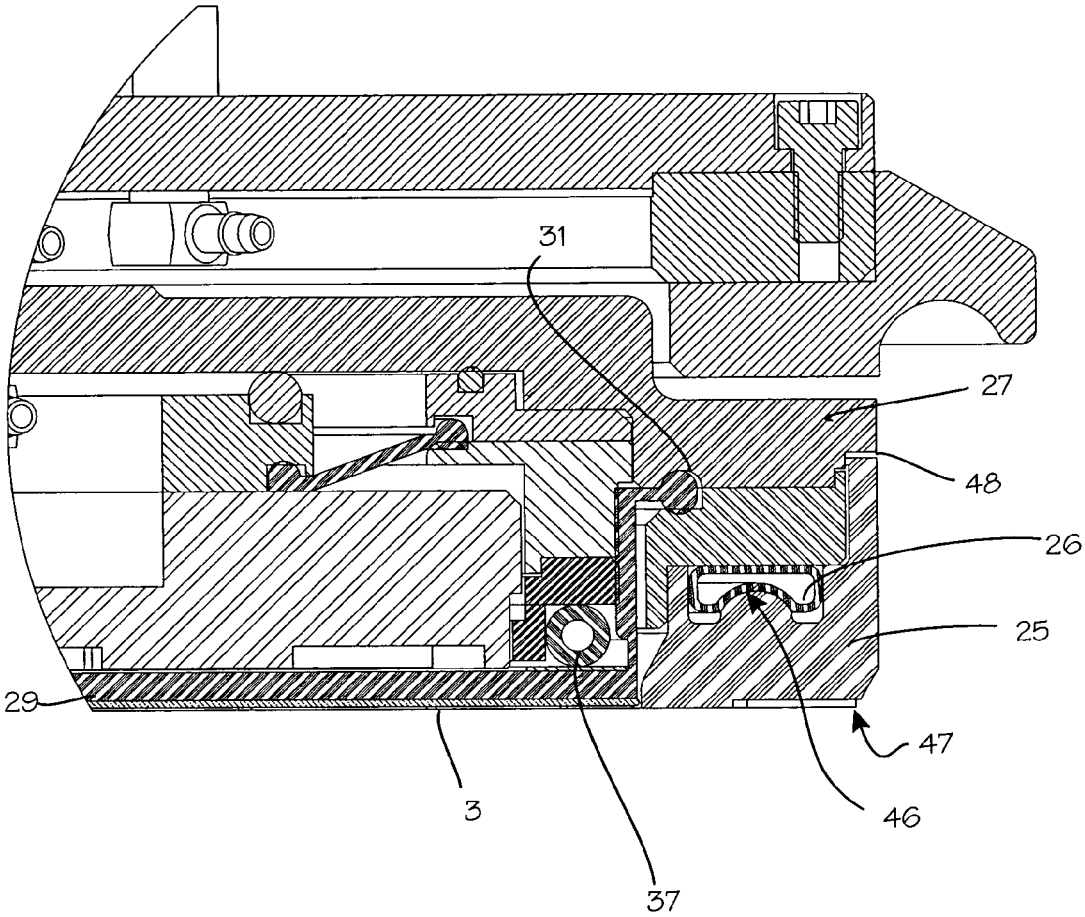
FIG. 4 shows a more detailed view of a wafer carrier having a pressure-regulated soft membrane, a pressure regulated retaining ring actuator, and an edge control bladder.

FIG. 4 shows a view of the wafer carrier 2 in greater detail. The figure illustrates the soft membrane 29 that distributes pressure to the wafer 3 during polishing while isolating the wafer 3 from the piston plate 28, housing 24 and gimbal plate 27. An extension of the membrane 29 is shown projecting into the annular space 31. The retaining ring is also shown 25. The retaining ring actuator 26 transmits an adjustable pressure to the retaining ring 25 while isolating the retaining ring 25 from the gimbal plate 27 and housing 24. A land 46 with a curved surface in the retaining ring 25 maintains area relationship between the actuator 26 and the retaining ring 25 while allowing pre-collapsing of the retaining ring actuator 26 to achieve maximum travel of the ring and minimize dead-band. A squaring notch 47 is incorporated on the retaining ring 25 to maintain area relationship between the polishing pad and area of the retaining ring 25 in contact with the polishing pad. Vertical motion of the retaining ring 25 in relation to the gimbal plate 27 and housing 24 is accommodated by a slot 48 in the retaining ring.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A wafer carrier comprising:

a housing;

a retaining ring characterized by an inner diameter and coupled to the housing, said retaining ring having a groove disposed therein;

a pressurizable retaining ring actuator disposed within the groove, said retaining ring actuator sized and dimensioned to substantially conform to the size and dimensions of the groove; and an inflatable soft membrane extending across a bottom surface of a piston plate in the wafer carrier disposed within the inner diameter of the retaining ring;

wherein the soft membrane further extends vertically between the piston plate and the retaining ring and extends into an annular groove disposed within the housing.

2. The wafer carrier of claim 1 wherein the annular groove is sized and dimensioned so as to allow the soft membrane to move independently of the housing within the annular groove.

3. The wafer carrier of claim 1 further comprising a passive edge control bladder disposed within the wafer carrier, said bladder further disposed such that the passive edge control bladder applies pressure to the edge of a wafer held by the wafer carrier.

4. The wafer carrier of claim 1 wherein the retaining ring actuator pressure is controllable to effectuate a change in pressure applied to the retaining ring.

5. The wafer carrier of claim 2 wherein the retaining ring actuator pressure may be changed effectuating a change in pressure applied to the retaining ring.

6. The wafer carrier of claim 1 wherein the retaining ring comprises a squaring notch disposed on its bottom surface.

7. The wafer carrier of claim 1 wherein the soft membrane is inflated to apply force to a backside of a wafer being held by the wafer carrier.

8. The wafer carrier of claim 2 wherein the soft membrane is inflated to apply force to a backside of a wafer being held by the wafer carrier.

9. The wafer carrier of claim 3 wherein the soft membrane is inflated to apply force to a backside of a wafer being held by the wafer carrier.

10. The wafer carrier of claim 1 further comprising a control system, said control system programmed to regulate pressures in the retaining ring actuator and behind the soft membrane are regulated independently.

11. The wafer carrier of claim 3 further comprising a control system, said control system programmed to regulate pressures in the retaining ring actuator and behind the soft membrane are regulated independently.

12. A method for wafer planarization comprising:

providing a wafer carrier comprising:

a housing;

a retaining ring characterized by an inner diameter and coupled to the housing, said retaining ring having a groove disposed therein;

a pressurizable retaining ring actuator disposed within the groove, said retaining ring actuator sized and dimensioned to substantially conform to the size and dimensions of the groove, said retaining ring actuator able to be pressurized; and an inflatable soft membrane extending across a bottom surface of a piston plate in the wafer carrier, said inflatable soft membrane disposed within the inner diameter of the retaining ring;

wherein the soft membrane further extends vertically between the piston plate and the retaining ring and extends into an annular groove disposed within the housing;

inflating the soft membrane in the wafer carrier to apply downward force to a wafer during CMP; and pressurizing the retaining ring actuator to adjust a force of a retaining ring acting on a polishing pad.

13. The method of claim 12 further comprising the step of independently regulating pressure behind the soft membrane and pressure in the retaining ring actuator.

14. The method of claim 12 wherein the inflatable soft membrane moves independent of the housing within the annular groove.

15. The method of claim 12 wherein pressurized fluid within the soft membrane urges the soft membrane downwardly away from the lower face of the piston plate and pushes the piston plate upwardly within the housing.

* * * * *